United States Patent [19]

Shotwell

[11] Patent Number: 4,613,004

[45] Date of Patent: Sep. 23, 1986

[54] EARTH BORING BIT WITH LABYRINTH SEAL PROTECTOR

[75] Inventor: Duane E. Shotwell, Houston, Tex.

[73] Assignee: Hughes Tool Company - USA, Houston, Tex.

[21] Appl. No.: 795,574

[22] Filed: Nov. 6, 1985

[51] Int. Cl.[4] ..... E21B 10/22

[52] U.S. Cl. ..... 175/371; 277/177; 277/188 R; 384/93; 384/94

[58] Field of Search ..... 175/372, 371; 384/94, 384/92, 93, 95; 277/177, 165, 188 R, 188 A, 92

[56] References Cited

U.S. PATENT DOCUMENTS

| | | | |
|---|---|---|---|
| 2,898,134 | 8/1959 | Moskow | 277/188 R |
| 3,094,335 | 6/1963 | Shenk | 277/177 X |
| 4,168,868 | 9/1979 | Shields | 384/93 |
| 4,194,792 | 3/1980 | Rife | 384/93 |
| 4,199,156 | 4/1980 | Oldham et al. | 277/92 |
| 4,209,890 | 7/1980 | Koskie, Jr. | 29/450 |
| 4,235,480 | 11/1980 | Olschewski et al. | 175/372 X |
| 4,306,727 | 12/1981 | Deane et al. | 175/371 X |
| 4,516,641 | 5/1985 | Burr | 175/372 X |

*Primary Examiner*—Stephen J. Novosad
*Attorney, Agent, or Firm*—Robert A. Felsman

[57] ABSTRACT

An earth boring bit with sealed and lubricated bearings and rotatable cutters, the seals being isolated from detritus in the borehole by a seal protector ring and groove. The ring, generally L shaped in cross-section, has radial and axial clearances from the registering groove to maintain a labyrinth path with selected values, irrespective of cone movement during drilling.

2 Claims, 2 Drawing Figures

EARTH BORING BIT WITH LABYRINTH SEAL PROTECTOR

BACKGROUND OF THE INVENTION

1. Field of the Invention

This invention relates in general to earth boring bits, especially to those having improvements to exclude detritus from the seal systems that retain lubricant around the bearing shafts of drill bits with rotatable cuutters.

2. Description of the Prior Art

Earth boring bits of the type with rotatable cutters commonly have lubrications systems that include a hydrostatic pressure compensator and pressure relief means, as shown in U.S. Pat. No. 4,276,946, Biased Lubricant Compensator For An Earth Boring Drill Bit, July 7, 1981. The most successful seal system is disclosed in U.S. Pat. No. 3,397,928, Seal Means For Drill Bit Bearings, Aug. 20, 1968.

There have been suggestions for additional rings that should help protect the seal means from the detritus in the drilling fluid surrounding the bit. U.S. Pat. No. 4,168,868, Sealing System For An Earth Boring Cutter, Sept. 25, 1979 discloses a washer ring located exterior of each O-ring type seal to act as a barrier to detritus, the washer preferably being semicircular or semi-ellipitcal in cross section.

Another form of seal protector is disclosed in U.S. Pat. No. 4,194,795, Seal Protector For A Sealed Bearing Rock Bit, Mar. 25, 1980. This protector extends across the clearance between the seal and the gland, and includes among other features, an inner contoured face having a low coefficient of friction to mate with the exterior of the seal to reduce friction.

U.S. Pat. No. 4,209,890, "Method of Making A Rotary Rock Bit With Seal Recess Washer", July 1, 1980, discloses a sealing system that includes a barrier to the pulverized cuttings and other materials in the borehole, which in its preferred form is a protective washer positioned outside an O-ring seal element in the gap between the base of rolling cone cutter and the body of the bit. Protective washers are provided in numerous thicknesses, and upon determination of the size of the gap, a washer is selected that will allow the gap to be narrowed to a size that will restrict passage of most of the abrasive particles in the drilling fluid. However, the size of the gap may be expected to increase as the cone moves axially on the bearing shaft during drilling. The protective washer is pressed into a recess in the cone mouth opening of the rolling cone cutter.

SUMMARY OF THE INVENTION

It is the general object of the invention to provide an improved seal protector for an earth boring bit of the type having rotatable cutters. This object is accomplished in general by using a seal protector in a registering groove formed in the cutter backface with a radially extending base portion and a generally axially extending shelf portion. The seal protector ring, generally L shaped as seen in cross-section, has an annular body and an annular lip to register respectively with the base and shelf portions of the groove. The dimensions of the seal protector ring in relation to those of the seal protector groove are such that upon assembly there is axially and radially clearance between them. This enables the maintenance of a labyrinth path with clearances between the groove and the protector ring at selected values even when the cone moves during earth drilling.

The above as well as additional objects, features, and advantages of the invention will become apparent in the following detailed description.

DESCRIPTION OF THE PREFERRED EMBODIMENT

Figure 1:
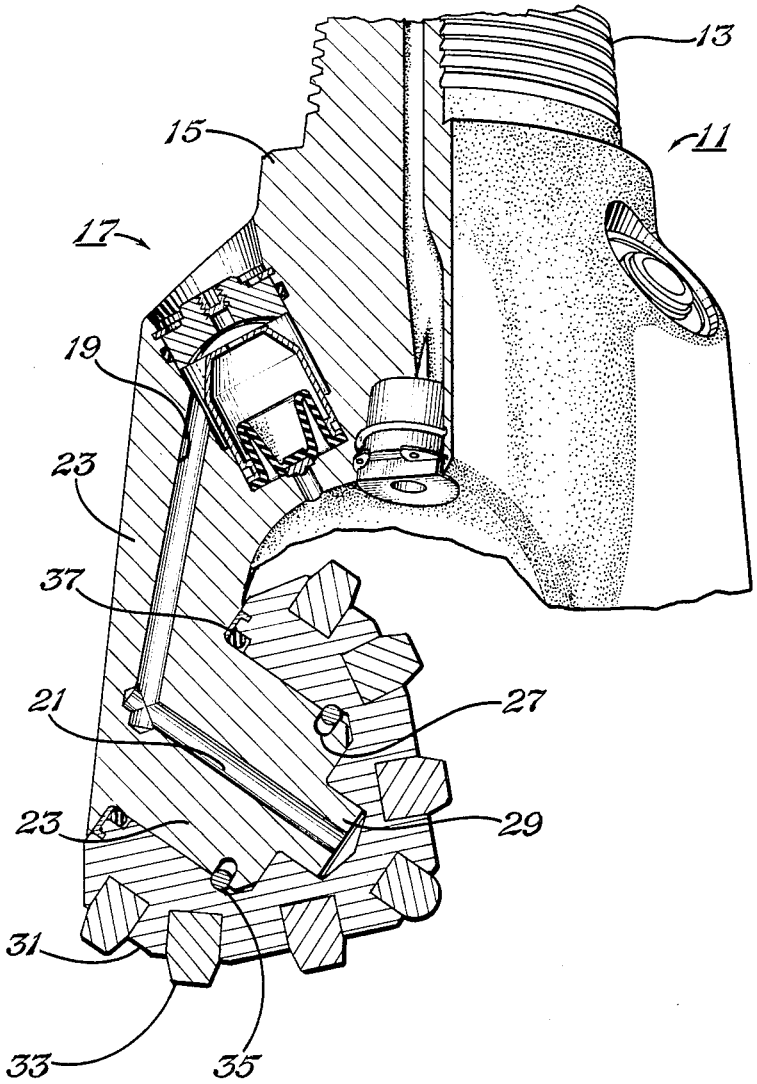
FIG. 1 is a fragmentary view of an earth boring bit, partial in longitudinal section, showing interior regions of one head section, the rotatable cone it supports, the cone retention system and the seal protector ring and groove constructed in accordance with the principles of the invention.

The numeral 11 of the drawing designates an earth boring drill bit having a threaded upper end 13 for attachment to a drill string member (not shown), being composed of preferably three head sections 15, each of which has a compensator type lubricant system 17 that provides lubricant through passages 19 and 21. (See U.S. Pat. No. 4,276,946, supra.)

The head section 15 has a cantilevered bearing shaft 23 extending inwardly and downwardly to form a journal bearing surface 25, the shaft also having a thrust bearing surface 27 and a pilot 29 to form as the inward most radial bearing surface.

A conically shaped cutter 31, with earth disintegrating teeth 33 (here tungsten carbide inserts or compacts), is secured for rotation about the cantilevered bearing shaft 23, being retained by a metallic, resilient snap ring 35, the construction of which may be better seen with reference to U.S. Pat. No. 4,491,428, "Earth Boring Drill Bit With Snap Ring Cutter Retention", Jan. 1, 1985.

An O-ring seal means 37 is positioned in a seal groove or gland 39 (see especially FIG. 2), the O-ring and seal groove preferably being of the form disclosed in U.S. Pat. No. 3,397,928, supra. A seal protector groove 41 is formed in the cutter backface 43, having what may be visualized as a radially extending base portion 45 positioned axially outward toward the exterior of the drill bit from the seal groove 39, and a generally axially extending shelf portion 47 positioned outwardly, and partially covering, the seal groove 39.

A seal protector ring 49, generally L shaped as seen in longitudinal cross-section (see FIG. 2) has an annular body 51 and an annular lip 53 to register respectively with the radial base portion 45 and the shelf portion 47 of the seal protector groove 41.

The innermost region 55 of the annular body 51 of the seal protector ring 49 has a curved configuration to mate with the curved portion of the bearing shaft 23.

Figure 2:
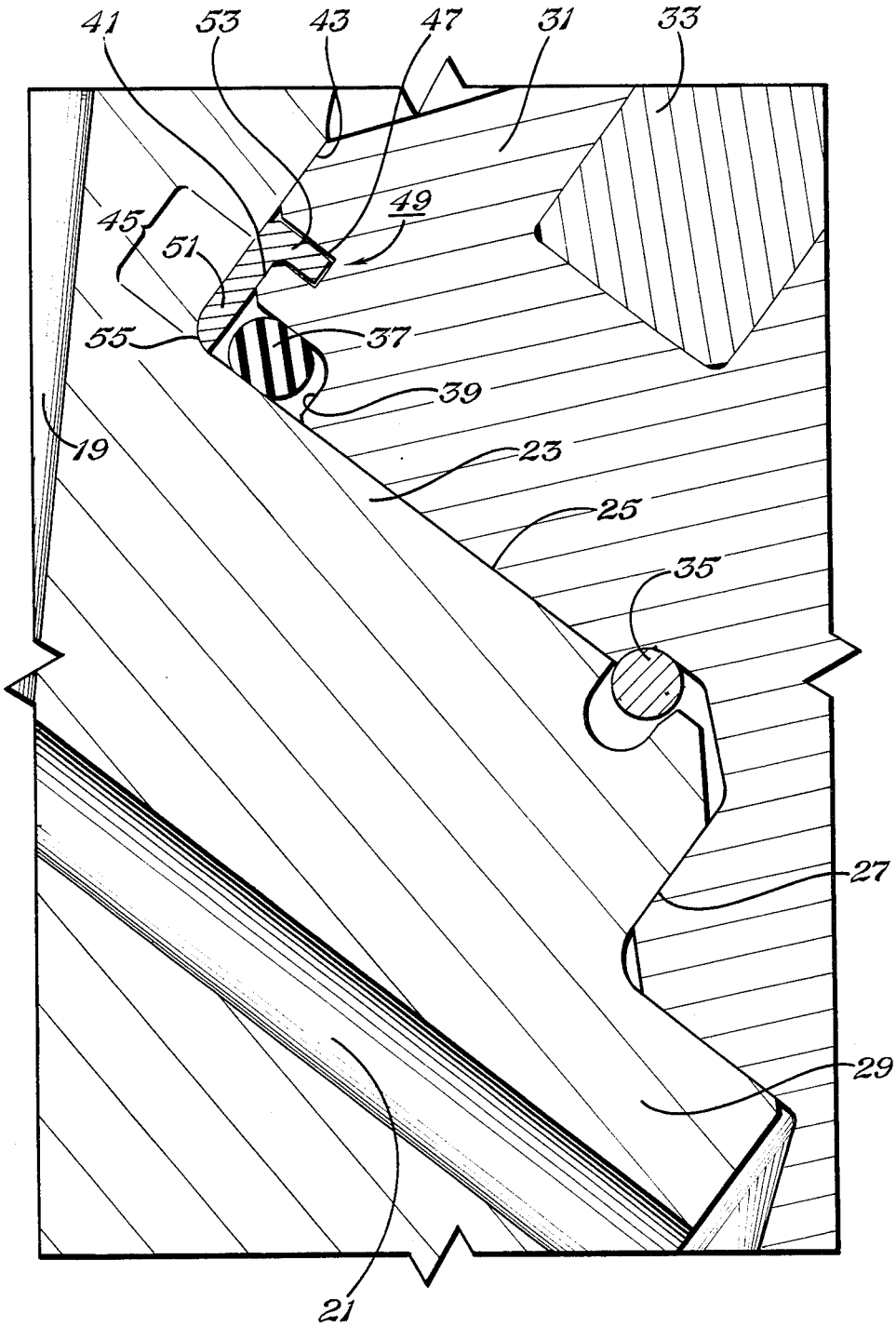
FIG. 2 is is an enlarged view of the head section, bearing shaft and the cone region that more clearly illustrates the preferred structure of the improved protector seal.

As may be seen with reference to FIG. 2, the axial thickness of the annular body 51 of the protector ring 49 is less than the axially measured distance across the seal protector groove 41. This clearance is determined by reference to the tolerances such that the cone or cutter 31 may move, during drilling, in or out on the cantilevered bearing shaft 23 without restricting the protector ring from free floating in the protector groove. Further, the radially measured distance across the axially extending shelf portion 47 of the protector groove 41 is greater than the radially measured thickness of the annular lip 53 of the seal protector ring 49 by a minimum distance such that there is no contact between the cutter and the protector ring when the cone moves during drilling. Preferably, the protector ring 49 is manufactured of a stainless steel such as Carpenters Custom 450 and is heat treated to have a hardness of about 45 Rockwell "C".

It should be apparent from the foregoing description that the invention has significant advantages. The configuration of the seal protector ring 49 and its registering seal protector groove 41 provides a labyrinth that restricts the flow of detritus from the drilling fluid in the borehole into the seal groove 39, and thus protects the seal means 37 and surrounding groove surfaces from premature abrasive wear. Since the protector ring 49 can be made of a material different from that of the head section 51 and cantilevered bearing shaft 23, optimum physical and chemical properties may be utilized to minimize wear. The above special configuration of the protector ring 49 provides an effective labyrinth to the entry of detritus into the seal groove 39. Further, the shape of the protector ring 49 enables the provision of axial and radial clearances that make the spaces between the protector ring 49 and the registering protector groove 41 a uniform size, independent of axial, radial or wobbling movements of the cutter 31 on the bearing shaft 23 during drilling. Thus, there has been provided an effective seal protector in an earth boring bit.

While the invention has been described in only one of its forms, it should be apparent to those skilled in the art that it is not thus limited, but is susceptible to various changes and modifications without departing from the spirit thereof.

I claim:

1. An earth boring bit having an improved seal protector, which comprises:

a bit body having at least one head section with a cantilevered bearing shaft extending from its base generally inwardly and downwardly to form a bearing surface;

an earth disintegrating cutter rotatably secured to the bearing shaft, with a radial backface positioned over the base of the shaft;

the cutter having an annular seal groove formed in the backface to oppose the base of the bearing surface;

seal means positioned in the annular seal groove;

a seal protector groove formed in the cutter backface, with a radially extending, base portion positioned outwardly from the seal groove and a generally axially extending, shelf portion positioned outwardly of the seal groove;

a seal protector ring, generally L-shaped as seen in cross section, with an annular body and an annular lip, to register respectively with the base the shelf portions of the seal protector groove;

whereby the seal means is protected from ambient detritus.

2. An earth boring bit having an improved seal protector, which comprises:

a bit body having at least one head section with a cantilevered bearing shaft extending from its base generally inwardly and downwardly to form a bearing surface;

an earth disintegrating cutter rotatably secured to the bearing shaft, with a radial backface positioned over the base of the shaft;

the cutter having an annular seal groove formed in the backface to oppose the base of the bearing surface;

seal means positioned in the annular seal groove;

a seal protector groove formed in the cutter backface, with a radially extending, base portion positioned outwardly from the seal groove and a generally axially extending, shelf portion positioned outwardly of the seal groove;

a seal protector ring, generally L-shaped as seen in cross section, with an annular body and an annular lip, to register respectively with the base and shelf portions of the seal protector groove;

the dimensions of the seal protector ring in relation to those of the seal protector groove being such that upon assembly there is axial and radial clearances between them;

whereby the seal means is protected from ambient detritus.

* * * * *